US006012445A

United States Patent [19]

Santelli, Jr.

[11] Patent Number: 6,012,445

[45] Date of Patent: Jan. 11, 2000

[54] APPLIANCE CONTROL KNOB GUARD

[76] Inventor: Albert Santelli, Jr., 123 N. Mountain Ave., Bound Brook, N.J. 08805

[21] Appl. No.: 09/248,539

[22] Filed: Feb. 11, 1999

[51] Int. Cl.[7] ..... F24C 3/12

[52] U.S. Cl. ..... 126/42; 126/214 A

[58] Field of Search ..... 126/42, 24, 211, 126/212, 214 D, 214 R; 431/158; 74/553

[56] References Cited

U.S. PATENT DOCUMENTS

| | | | |
|---|---|---|---|
| 1,244,790 | 10/1917 | Stevenson | 126/42 |
| 1,729,425 | 9/1929 | Helrich | 126/42 |
| 1,949,178 | 2/1934 | Pack | 126/42 |
| 3,043,289 | 7/1962 | Fox | 126/42 |
| 4,836,181 | 6/1989 | Saga | 126/42 |
| 5,357,943 | 10/1994 | Edgerton | 126/214 |
| 5,363,720 | 11/1994 | Sanchez | 74/553 |
| 5,377,660 | 1/1995 | Bombardier | 126/42 |
| 5,438,974 | 8/1995 | Maldonado | 126/42 |

*Primary Examiner*—James C. Yeung
*Attorney, Agent, or Firm*—Buchanan Ingersoll; Paul A. Schwarz

[57] ABSTRACT

A guard for preventing the turning of at least one control knob of an appliance. The guard has a resilient, elongated sleeve member for enclosing one or more control knobs. A slot defined in the sleeve permits a shaft, rotated by the control knob, to extend through the sleeve. The sleeve member can be made from a transparent material which permits the rotational position of the knob or knobs to be viewed through the guard.

6 Claims, 3 Drawing Sheets

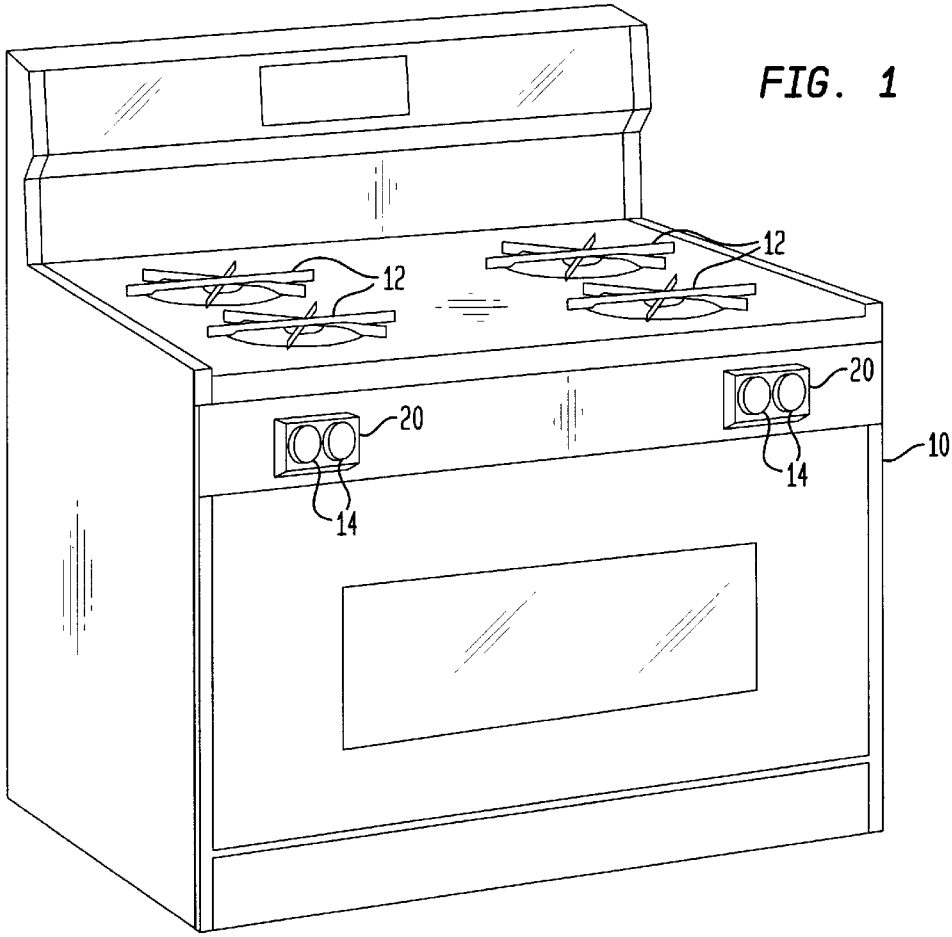
FIG. 1
FIG. 2
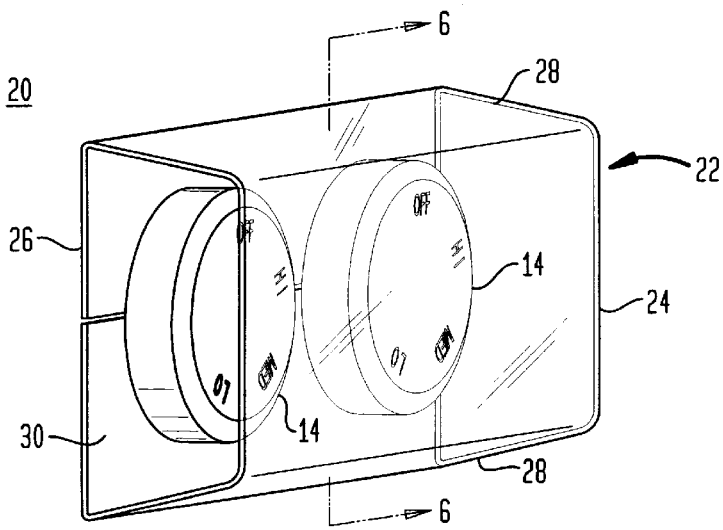

APPLIANCE CONTROL KNOB GUARD

FIELD OF THE INVENTION

The present invention relates to appliance control knob guards, and in particular, to a guard which is adapted to be placed over at least one control knob of an appliance to prevent toddlers or small children from rotating the knob and operating the appliance.

BACKGROUND OF THE INVENTION

The kitchen is one of the most hazardous areas in the home for children. A major hazard in kitchens are appliances such as ovens and stoves, which have control knobs which are easily accessible to children. Since children are curious and not typically aware of the dangers of such appliances, they often turn and operate the easily accessible control knobs when not supervised. Operation of the control knobs by a child can cause the child serious burn injuries, start fires, damage the appliance, or ruin food being processed by the appliance.

There are many known devices which attempt to avoid these dangers by preventing child access to the control knobs on the front of appliances. For example, U.S. Pat. No. 4,836,181 discloses an oven control-knob guard that attaches to the oven and shields the controls and the burners from inadvertent contact by a child or other person. The guard includes a front plate and cooperating side plates. The front plate can be raised and lowered to gain or block access of the control-knobs.

U.S. Pat. No. 5,438,974 also discloses an oven control-knob guard plate that attaches to the oven and shields the controls from inadvertent contact by a child or other person. The guard-plate described therein is outwardly angled to permit access to the control-knobs from above by an adult.

The guard plates described above are designed to be attached to the oven or stove with screw fasteners which makes them somewhat complicated to install and remove. Moreover, the guard plates undesirably reduce the aesthetic appearance of the stove or oven.

Devices which prevent rotation of the control knobs on the front of stoves or ovens are also known. Such a device is disclosed in U.S. Pat. No. 5,363,720, which describes a dome-shaped cap that installs over a standard stove control-knob to prevent children from turning or engaging the knob. A pair of spring biased latches on each side of the cap retains the cap to the knob. When the cap is rotated it merely spins relative to the knob thereby preventing rotation of the knob. Squeezing the latches permits the cap to be removed from the knob.

Unfortunately, there may be children who discover how to remove the cap from the control knob, thus defeating it. Moreover, the separately attached spring biased latches add to the manufacturing costs of the device.

Accordingly, there exists a continuing need for an improved guard for appliance control knobs.

SUMMARY OF THE INVENTION

A guard for preventing the turning of at least one control knob of an appliance. The guard comprises a resilient, elongated sleeve member for enclosing one or more control knobs. A slot defined in the sleeve permits a shaft, rotated by the control knob, to extend through the sleeve. The sleeve member can be made from a transparent material which permits the rotational position of the knob or knobs to be viewed through the guard.

BRIEF DESCRIPTION OF THE DRAWINGS

The advantages, nature and various additional features of the invention will appear more fully upon consideration of the illustrative embodiments now to be described in detail in connection with the accompanying drawings. In the drawings:

FIG. 1 is a perspective view of a typical appliance having two pairs of control knobs and a guard made according to an embodiment of the present invention installed over each pair of the control knobs;

FIGS. 2 and 3 are an enlarged perspective views of one of the guards shown in FIG. 1, wherein FIG. 2 shows the guard installed on the control knobs and FIG. 3 shows the guard removed from the control knobs;

Figure 3:
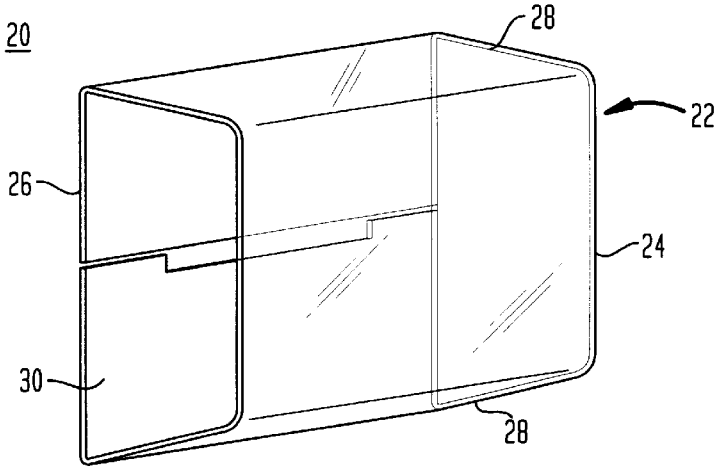

It should be understood that the drawings are for purposes of illustrating the concepts of the invention and are not to scale.

DETAILED DESCRIPTION OF THE INVENTION

FIG. 1 shows a typical appliance such as a combination stove and oven 10 having four stove burners 12 operated by two pairs of control knobs 14. A guard 20 made according to an embodiment of the present invention is installed over each pair of control knobs 14 to prevent their rotation, especially by children.

FIG. 2 is an enlarged view of one of the guards 20 shown in FIG. 1. The guard 20 is made from a transparent material which enables the position of the knobs 14 to be viewed through the guard 20. This feature advantageously allows monitoring of the stove burners 14 during cooking when the guards 20 are in place.

Figure 4:
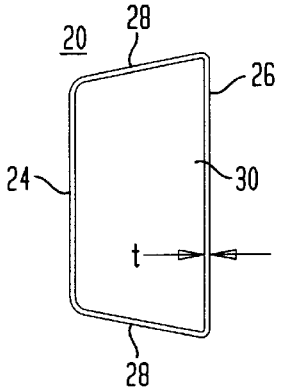
FIG. 4 is an end view of the guard shown in FIG. 3.
Figure 5:
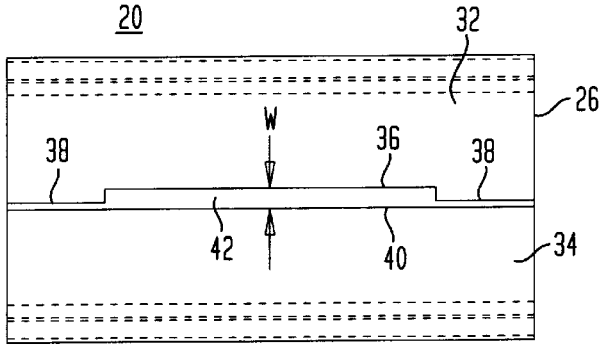
FIG. 5 is a rear view of the guard shown in FIG. 3.

FIGS. 3–5 collectively show the guard 20 of FIG. 2 removed from the control knobs. The guard 20 is constructed as an elongated, open-ended sleeve member 22 having a front wall 24, a rear wall 26 and a pair of side walls 28 which form an interior 30 dimensioned for receipt of two typically sized appliance control knobs. The walls 24, 26, 28 of the guard 20 are substantially planar, and arranged such that the guard 20 in cross-section, defines a trapezoid. It should be understood, however, that other embodiments of the guard can be constructed with one or more substantially non-planar walls arranged in other cross-sectional configurations to adapt the guard to fit variously sized and shaped control knobs as will be described further on.

Figure 6:
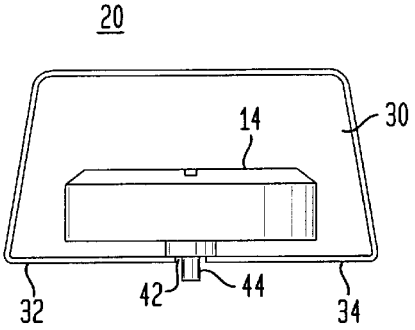
FIG. 6 is a cross-sectional view through line 6—6 of the guard shown in FIG. 2.

As best seen in FIG. 5 the rear wall 28 of the guard 20 is split into first and second rear wall sections 32, 34, each of which is unitary with a respective one of the side walls 28. At least one of the first and second rear wall sections 32, 34 includes a stepped edge 36 (shown in the first rear wall section 32) which defines a pair of stop tabs 38. The other one of the first and second rear wall sections 32, 34 includes a straight edge 40 (shown in the second rear wall section 34). The stepped and straight edges 36, 40 form a slot 42 having a width w therebetween, with the stop tabs 38 substantially enclosing each end of the slot 42. The width w of the slot 42 permits the shaft 44 coupling the control knob 14 to the appliance to extend freely into the interior 30 of the guard 20 as shown in FIG. 6.

The guard 20 is typically made from a transparent resilient material, such as transparent PVC, having a wall thickness t (FIG. 4) of about 0.040 inches, although other materials having different wall thicknesses can also be used. During installation and removal of the guard 20, the resiliency of the guard 20 permits an adult to manually spread apart the rear wall sections 32, 34 to create opening between the stop tabs 38 and the straight edge of the rear wall sections 32, 34. This in turn, allows the guard 20 to slide over the shafts 44 of the control knobs 14. The stop tabs 38 aid in preventing children from removing the guard 20 as the shafts 44 of the control knobs 14 will engage the stop tabs 38 when an attempt is made to remove the guard 20 from the knobs 14 without spreading apart the rear wall sections 32, 34.

Figure 7:
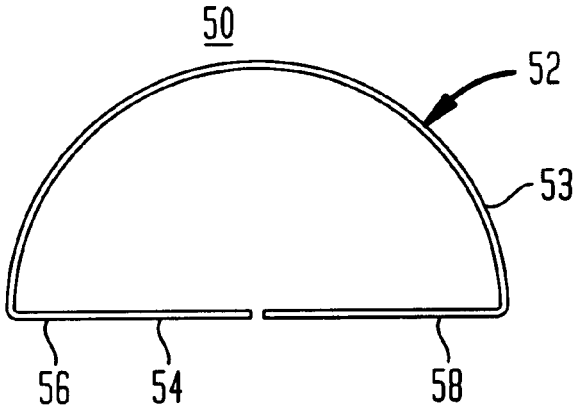
FIG. 7 is an end view of a guard according to a second embodiment of the present invention.

FIG. 7 shows a guard 50 according to a second embodiment of the present invention. In this embodiment, the guard 50 is also constructed as an elongated, open-ended sleeve member 52 however, it comprises a single curved front wall 53 and a substantially planar rear wall 54 which together, define a D-shaped or semicircular cross-section. The rear wall 54 is split into first and second rear wall sections 56, 58 and a slot (not shown) as described in the embodiment of FIGS. 1–6.

Figure 8:
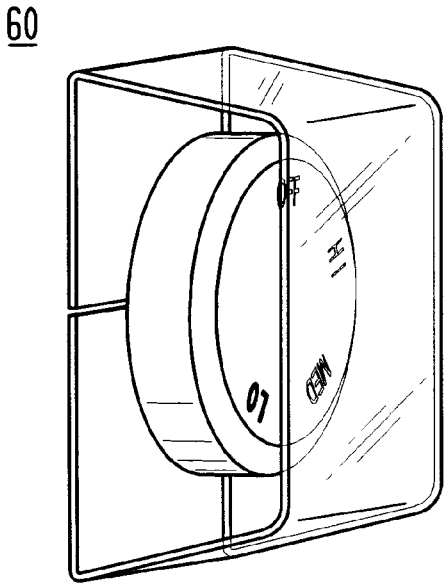
FIG. 8 is a perspective view of a guard according to a third embodiment of the present invention.

FIG. 8 shows a guard 60 according to a third embodiment of the present invention. This guard 60 is substantially identical to the guard 20 shown in FIGS. 1–6 except, that it has been dimensioned for use on a single appliance control knob 14.

It should be understood that the above described embodiments are illustrative of only a few of the many possible specific embodiments which can represent applications of the principles of the invention. Numerous and varied other arrangements can be devised by those skilled in the art without departing from the spirit and scope of the invention.

What is claimed is:

1. A guard for preventing the turning of at least one control knob of an appliance, the guard comprising a resilient, elongated sleeve member for enclosing the control knob, the sleeve including a slot which permits a shaft, rotated by the control knob, to extend through the sleeve, the sleeve split into two wall sections, one of the wall sections defining a stepped edge and the other one of the wall sections defining an edge, the slot being formed between the stepped edge and edge of the wall sections.

2. The guard according to claim 1, wherein the sleeve includes at least one wall, the slot being defined in the wall.

3. The guard according to claim 1, wherein the sleeve includes at least two walls, the slot being defined in one of the two walls.

4. The guard according to claim 1, wherein the sleeve is split into two wall sections, each wall section defining an edge, the slot being formed between the edges of the wall sections.

5. The guard according to claim 1, wherein the resilient, elongated sleeve member is transparent.

6. The guard according to claim 1, wherein the sleeve member is dimensioned for receiving two of the control knobs.

* * * * *